United States Patent [19]

Björck et al.

[11] Patent Number: 4,697,743

[45] Date of Patent: Oct. 6, 1987

[54] METHOD OF FINELY CRUSHING PARTICLES OF MATERIAL IN AN IMPACT MILL AND APPARATUS FOR PERFORMING THE METHOD

[75] Inventors: Conny Björck, Västra Frölunda; Per A. Sigurdsson, Åskloster, both of Sweden

[73] Assignee: Sicomant AB Juteskarsgatan 38, Vastra Frolunda, Sweden

[21] Appl. No.: 676,885

[22] Filed: Nov. 30, 1984

Related U.S. Application Data

[63] Continuation-in-part of Ser. No. 453,897, Dec. 13, 1982, abandoned.

[51] Int. Cl.[4] ..... B02C 13/14; B02C 19/00

[52] U.S. Cl. ..... 241/5; 241/29; 241/97; 241/188 R; 241/189 R; 241/275; 241/DIG. 14

[58] Field of Search ..... 241/5, 80, 97, 275, 241/152 A, 154, 40, 186.2, 29, 186 R, 189 R, DIG. 14, 99, 188 R

[56] References Cited

U.S. PATENT DOCUMENTS

| | | | |
|---|---|---|---|
| 1,099,557 | 6/1914 | Lorenz et al. | 241/DIG. 14 X |
| 2,155,151 | 4/1939 | Schacht | 241/275 X |
| 2,226,330 | 12/1940 | Symons | 241/189 X |
| 2,287,799 | 6/1942 | Hartshorn | 241/275 X |
| 2,468,321 | 4/1949 | Bland | 241/275 X |
| 2,609,993 | 9/1952 | Planiol | 241/275 X |
| 2,620,988 | 12/1952 | Tellier | 241/99 X |
| 2,628,036 | 2/1953 | Hall | 241/99 X |
| 4,061,279 | 12/1977 | Sautter | 241/275 X |
| 4,138,067 | 2/1979 | Planiol | 241/275 |

FOREIGN PATENT DOCUMENTS

| | | | |
|---|---|---|---|
| 449043 | 6/1948 | Canada | 241/275 |
| 387995 | 1/1924 | Fed. Rep. of Germany | . |
| 1434420 | 5/1976 | United Kingdom | 241/275 |

*Primary Examiner*—Mark Rosenbaum
*Attorney, Agent, or Firm*—Holman & Stern

[57] ABSTRACT

A method and an apparatus for finely crushing particles of material in a mill comprising feeding the material to be crushed to a first impact position, impacting and impelling the particles from the first impact position by a rotating impact surface stationary impact surface to a and accelerating the particles in a vacuum to produce a sufficiently high impact energy at the first impact surfact to crush the particles fed thereto prior to the section impact surface. The particles to be comminuted are passed through a feeding tube or channel to a crushing chamber containing a rotor having its axle parallel to the feeding tube and having first impact surfaces thereon which are arranged to be parallel with the stationary impact surface, or surfaces, at the time they impact with the particles fed to the first impact position. The outlet of the feeding tube is located at the outer periphery of the rotor. Two or more circumferentially spaced feeding tubes may be provided and a recirculating system may also be provided to recirculate the particles after the stationary impact position back to an accelerator to be passed through the apparatus again.

18 Claims, 9 Drawing Figures

METHOD OF FINELY CRUSHING PARTICLES OF MATERIAL IN AN IMPACT MILL AND APPARATUS FOR PERFORMING THE METHOD

This application is a continuation-in-part of U.S. Ser. No. 453,897 filed Dec. 13, 1982, now abandoned.

BACKGROUND OF THE INVENTION

1. Field of the Invention

The present invention relates to a method of finely crushing particles of material in an impact mill, wherein at least one rotor provided with at least one impact surface projects the particles against stationary impact surfaces in the mill, the comminution taking place substantially in vacuum.

The invention also relates to an apparatus for performing the method.

2. Description of the Prior Art

Mechanical comminution of solid particles may be classified according to the manner of operation of the apparatus that performs the crushing. Crushing or milling may be performed according to two main principles. Either with pressure that ruptures the particles, as for instance by means of jaw crushers, pendulum mills, tower mills, roller mills and the like, or with kinetic energy that causes bursting of the particles. Typical examples of the latter category are hammer mills, pin mills and jet mills.

There is a great demand on the market for finely crushed material especially in the filler industry as fillers e.g. in the plastics and paper industries. Another large product area is finely milled quartz and feldspar for the ceramic industry. Todays technology for producing fine grained materials are very energy and cost demanding, especially when narrow tolerances in grain size and particle sizes below 30μ are desired. Sizes down to 45μ may be obtained with ball mills, but since the grinding balls usually consist of iron it is not possible to obtain iron-free milling. This type of milling therefore is not useable for materials which are to be used as whitening agents in the paper and in plastic industry, since even small proportions of iron destroy the whiteness. In order to arrive at particle sizes of 20μ, either conventional milling and air stream separation or a jet mill is used. The problem with air-separated material is that too much of too coarse fractions will be included, which is mostly not acceptable. With jet mills it is possible to arrive at particle sizes around 10μ and even smaller, but the jet mill has a low efficiency and a very high energy consumption (350–700 kWh/ton).

The amount of energy consumed in crushing by means of kinetic energy or impact energy may be divided into three main groups, viz. energy which is consumed for elastic deformation of the grains or particles and which is lost, supplied energy which bursts the grains, and energy for the operation of surrounding equipment etc. At low velocities, a substantial portion of the supplied energy will be used up for the elastic deformation of the particles, which gives a low efficency. Furthermore, the elastic deformation will cause the particles to bounce instead of bursting which will cause heavy wear. At high velocities, on the other hand, the energy consumed for elastic deformation amounts only to a small portion of the total energy, whereas the high impact energy, if it can be applied as "instantaneously" as possible, gives very high stress concentrations and provides an efficient crushing. This means that a high particle velocity and instantaneous impact force should be chosen. The jet mill which has proved to be especially suitable for crushing or milling into fractions with very small grains utilizes a high particle velocity and uses pressurized air for accelerating the grains to about 100 m/s, and the high velocity grains collide with other grains resulting in the grains bursting each other. However, due to the very high energy consumption per ton, low efficiency and very high production costs, the jet mill has so far only been used in "exclusive" connections, for instance in the chemical industry and the pharmaceutical industry.

It has also been suggested (German patent specification No. 387.995) to use disintegrators or stamp mills, the milling tools of which operate in an air-void space in order to obtain a fine grinding, preferably together with a dispersing agent.

BRIEF SUMMARY OF THE INVENTION

The object of the invention is to provide a comparatively simple method which, while involving a low energy consumption, may provide fractions with very small grains (below 10μ). This object has been attained in-feeding particles of material to be comminuted to a first impact position at a rotating impact surface moving in a direction substantially perpendicular to the feeding direction of said particles, the particles being fed to the rotating impact surface at the outer periphery thereof; propelling said particles by said impact at said first position against a stationary impact surface; positioning said stationary impact surface with respect to said rotating imapact surface at said first impact position to be impacted by said propelled particles substantially perpendicularly; evacuating the feeding and impact areas; and accelerating the particles in the vacuum produced by the evacuating step to produce a sufficient supply of particles to the first impact position so that the high impact energy of said rotating impact surface produces a first crushing of said particles by said rotating impact surface before said particles are propelled thereby against the stationary impact surface.

The invention also relates to an apparatus for comminuting particles of material in a centrifugal mill having at least one housing, at least one impact surface projecting radially from a rotor, stationary impact surfaces disposed about the path of rotation of said rotor and impact surface thereon, means for feeding particles to be crushed to the rotating impact surface, the rotor axle being parallel with the feeding direction of the particles, and means for generating a vacuum in the mill, the improvement comprising: at least one particle accelerator operating in a vacuum and operatively connected to the feeding means to keep the impact position supplied with particles so that a high impact energy on the particles by the impact surface at the outer periphery of the rotor impact surface to produce a crushing of the particles by said rotor impact surface before the particles are projected against said stationary impact surface.

BRIEF DESCRIPTION OF THE DRAWINGS

The invention will now be described in detail with reference to the accompanying drawings wherein.

DETAILED DESCRIPTION

Figure 1:
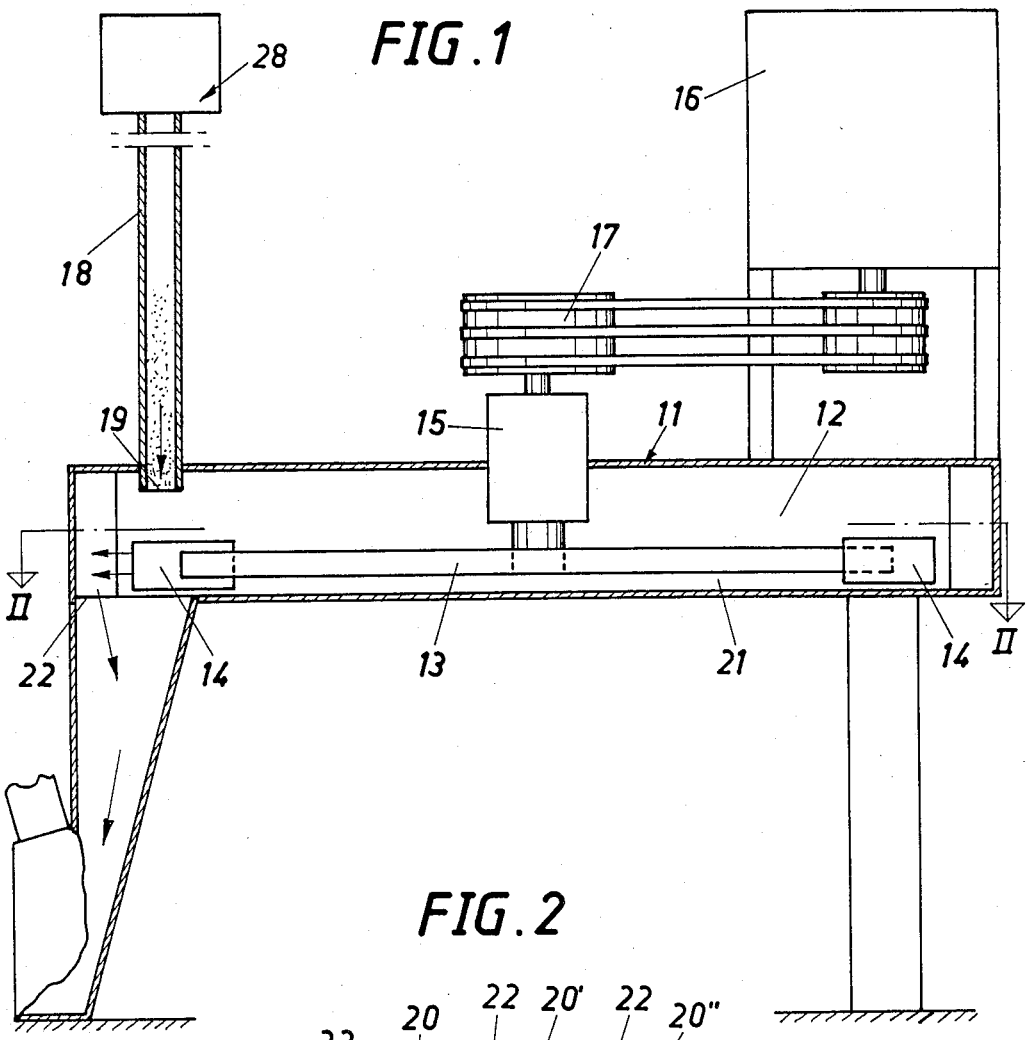
FIG. 1 is a diagrammatical cross-section view through a centrifugal mill according to the invention and intended for laboratory purposes.
Figure 2:
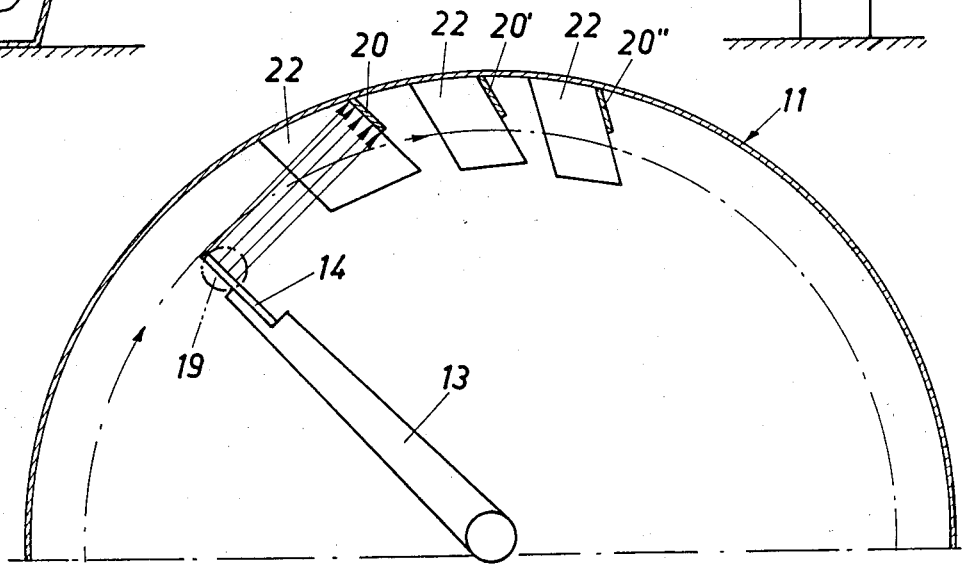
FIG. 2 is a cross-sectional view taken on the line II—II in FIG. 1.

The impact mill 10 according to the invention consists of a housing 11 which may be sealed airtight and which contains a crushing chamber 12 wherein there is rotatably arranged a rotor 13 which is provided at each end with an impact surface 14. The rotor is journalled in a heavy bearing 15 and is driven by a motor 16 by means of a suitable transmission 17. Opposite to the path of movement of the impact surfaces 14 there is provided at least one supply channel 18 through which particles of material that are to be finely divided are supplied intermittently the impact surface 14. The opening 19 of the supply channel 18 in the housing 11 is provided at some distance from an impact surface 20 which is oriented in such a way that it extends substantially in parallel with the rotor impact surface 14 when this is disposed below the outlet opening 19. In the embodiment shown in FIGS. 1 and 2, the impact surface 20 is disposed outside of the path of rotation of the impact surface 14. Any particles projected to the side of the impact surface 20 will be arrested by the following impact surfaces 20' and 20''. Below the impact surfaces 20, 20', 20 there is provided, in the bottom 21 of the crushing chamber, an outlet opening 22 through which the material which has been projected against the impact surfaces 14, and 20 and crushed thereby leaves the crushing chamber 12. The outlet opening 22 may be connected to a recirculation system of the kind illustrated in FIG. 8 which returns the particles to the supply channel 18. The outlet opening may also be connected to a feeding out device (not shown) for batchwise removal of the crushed material from the apparatus.

By the aid of a passive or active accelerator 28, the particles of material are supplied to the impact position where they are crushed by a very high impact velocity of the rotor impact surface or surfaces 14. The "passive" accelerator consists of a vertical tube 18 included in the air-void system and having such a length (for instance 3 m), that the impact velocity against the impact surface 14 of the rotor together with the rotor's own velocity will be so large, that the particles will be crushed a first time at this impact and the second time when they are projected against the stationary impact surfaces.

By the aid of a device not shown a vacuum is maintained in the accelerator 28, the crushing chamber 12 and spaces communicating therewith, so that the crushing chamber is practically air-free (the air should be evacuated to at least 90%). Due to this arrangement the rotor 13 with the impact surfaces 14 will not provide any fan action, and interfering shock waves and uncontrolled turbulency is avoided. The particles instantaneously hit by the impact surface will be crushed by the impact against the surface and will be projected tangentially out of the path of movement of the rotor and against one or several stationary impact surfaces 20 where further crushing takes place. A dosing device may be arranged in the accelerator 28 for feeding a suitable amount of particles of material to the impact surfaces 14.

Practical tests with a laboratory mill have shown that it is feasible to give the rotor a peripheral velocity of 180 m/s. However, for commercial operation, the upper practical limit for the peripheral velocity of the rotor would probably be about 400 m/s. In order to accelerate one ton of particles to a velocity of 180 m/s, 4,5 kWh are consumed, and at four circulations the theoretical energy consumption would be 36 kWh/ton. To this is added the energy consumed for recirculation and for the operation of the vacuum pump. Since the crushing takes place in vacuum and at a high velocity the losses will be moderate compared to current technology.

Figure 3:
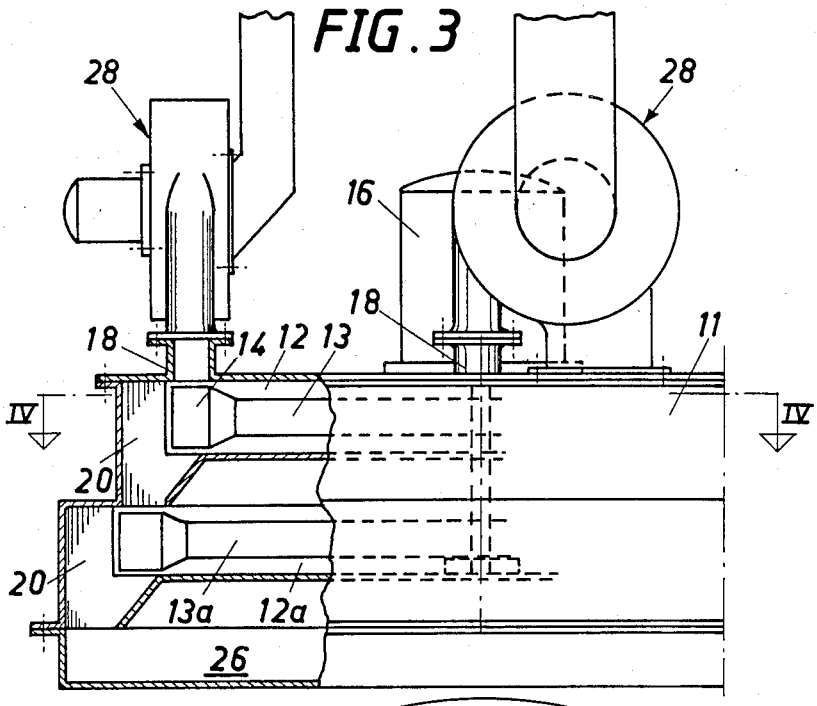
FIG. 3 is a partly broken diagrammatic cross-sectional view of a mill with twin rotors according to another embodiment of the invention.
Figure 4:
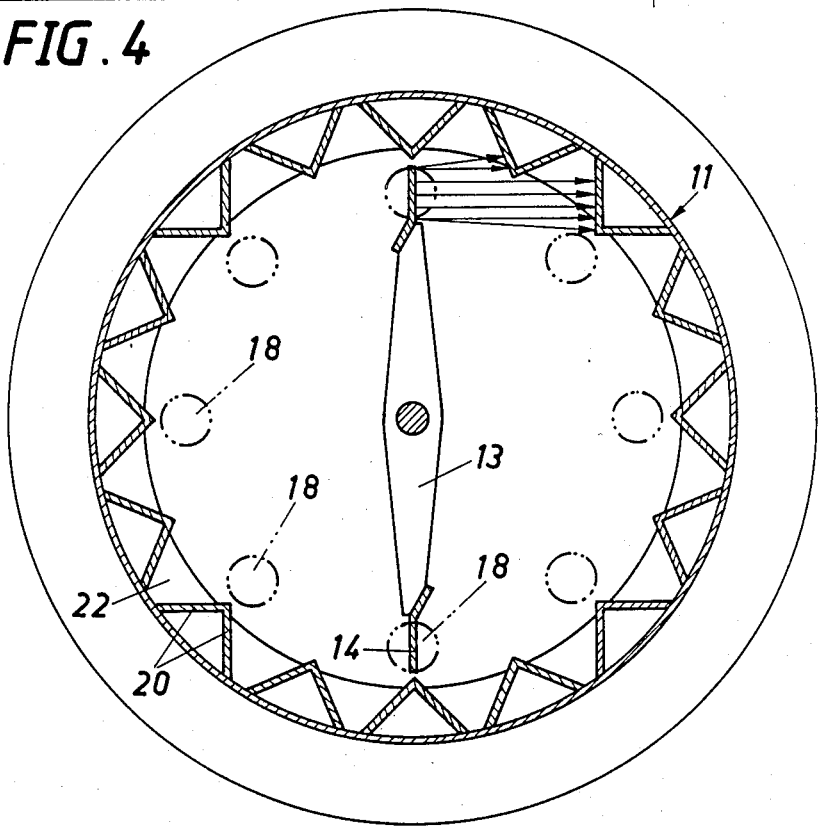
FIG. 4 is a cross-sectional view taken on the line IV—IV in FIG. 3.

The embodiments of FIGS. 3 and 4 differs from the above-described embodiment in two important respects: two or more rotors are arranged in parallel one above the other, and the particles are supplied to the first crushing chamber 12 with such a high kinetic energy, that a maximum amount of crushing material is supplied for each "beat". The necessary kinetic energy (which, however, is only about 1/10 of the rotational energy of the impact surface) is obtained by means of an "active" accelerator 28 which, as an example, may consist of a centrifuge, the blades of which are preferably rubber coated in order to reduce wear.

In the mill according to this embodiment the impact surfaces 20 are preferably oriented in such a way, that the particles will fall towards the next rotor **13*a* which is provided directly below and close to the rotor 13. In order to obtain a high capacity, a supply channel 18 is provided opposite to every other second impact surface 20. The impact surfaces 20 have a V-shaped cross-section whereby it will be possible to utilize the second leg of the V by reversing the motor. In this embodiment the two crushing chambers 12 and 12*a* as well as the collecting chamber 26 and the metering accelerator 28** are connected to one and the same vacuum system.

Figure 5:
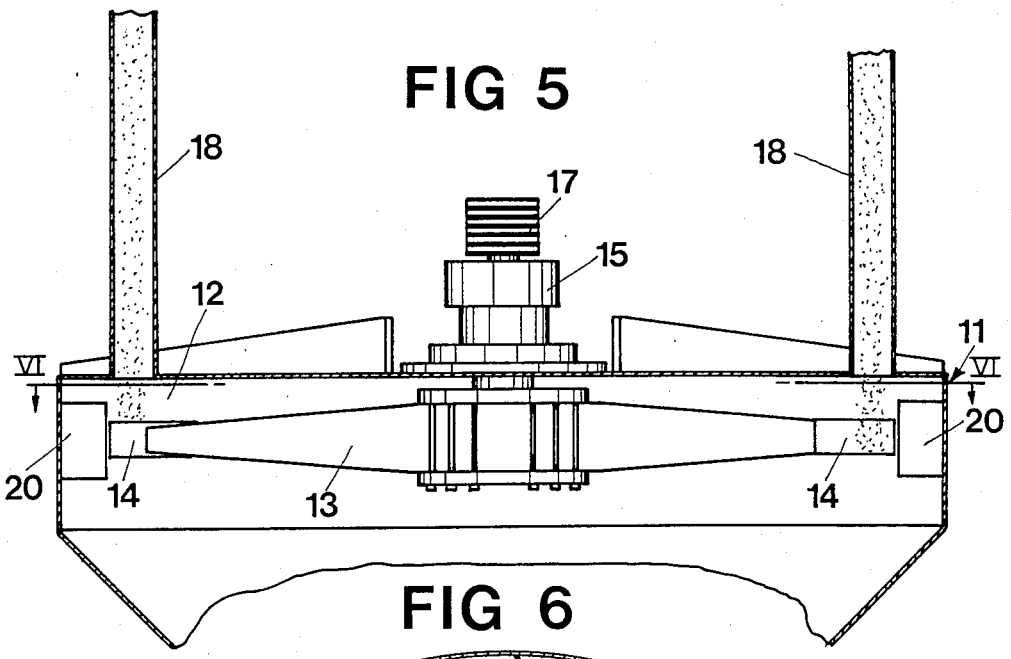
FIG. 5 is a schematic cross-sectional view through a further embodiment of a mill in accordance with the invention.
Figure 6:
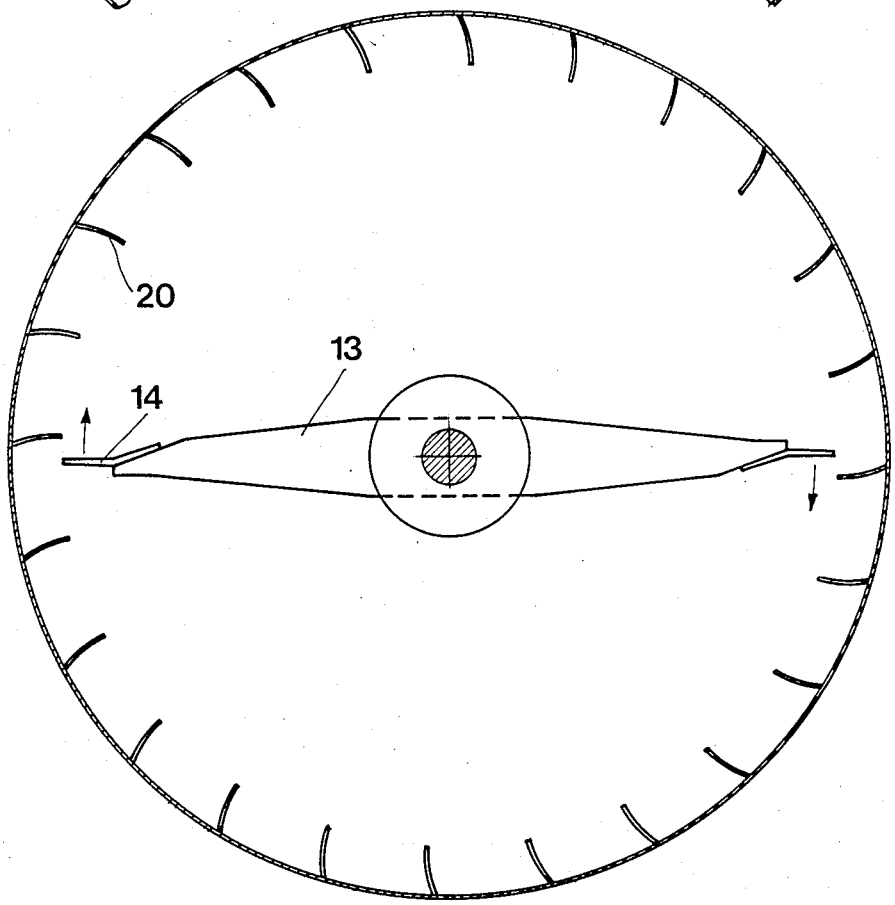
FIG. 6 is a cross-sectional view taken along line VI—VI of the mill according to FIG. 5.

In the embodiment disclosed in FIGS. 5 and 6 material is fed to the funnel-shaped crushing chamber 12 simultaneously via four supply channels 18 evenly distributed over the circumference of the crushing chamber. The number of supply channels 18 could also be two (diametrically opposed) or six or even more.

Figure 7:
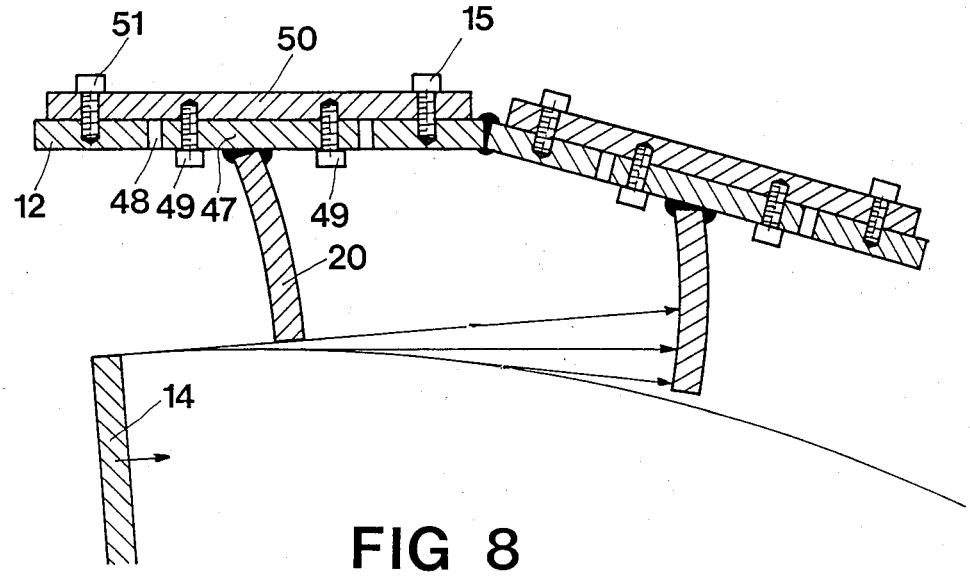
FIG. 7 is a cross-sectional view showing on a larger scale the attachment of the stationary impact surfaces.

In FIG. 7 is shown in detail an attachment means for the stationary impact surfaces 20 permitting removal and exchange of said impact surfaces. These are welded to inner plates 47 received in apertures 48 in the wall of the crushing chamber 12. The inner plates 47 are attached by screws 49 to outer plates 50 covering said apertures 48 and attached by screws 51 to the wall of the crushing chamber 12. By undoing the screws 51 the plates 47 and 50 and the impact surface 20 attached thereto can be removed from the crushing chamber 12.

The stationary impact surfaces 20 are slightly curved, so that the particles will be projected approximately perpendicularly against the stationary impact surfaces 20 from different positions of the path of movement as is indicated in FIG. 7.

Figure 8:
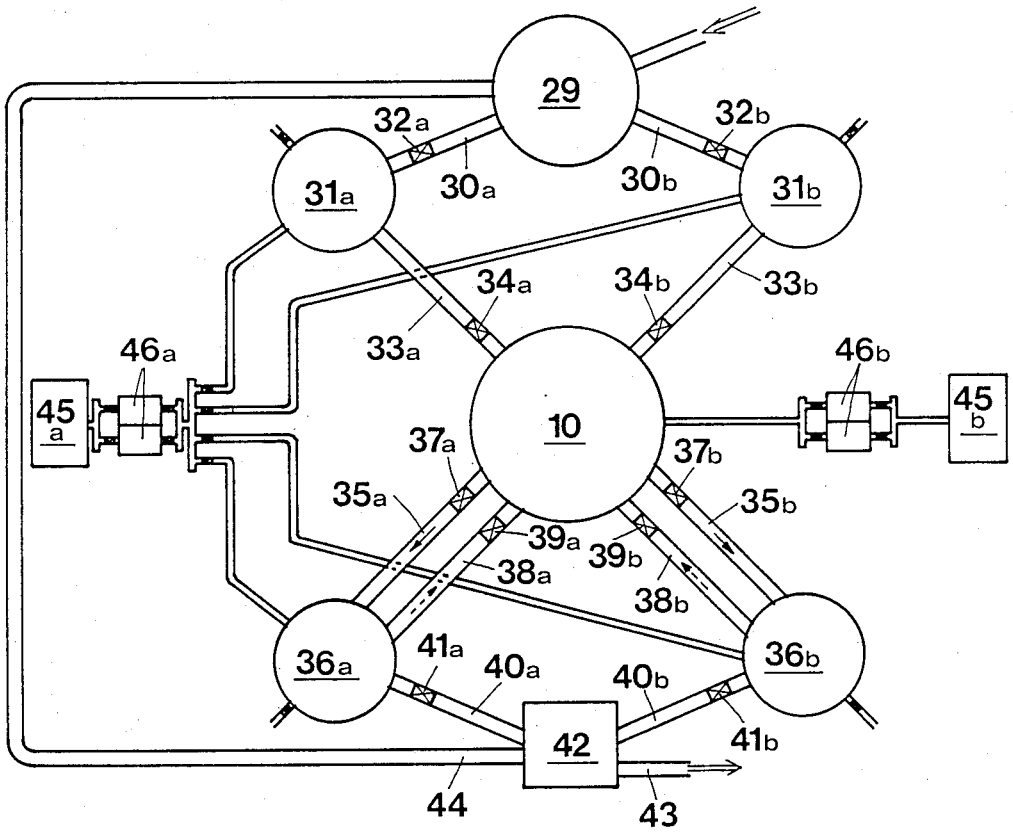
FIG. 8 is a flow diagram of a mill plant according to a further embodiment of the invention.
Figure 9:
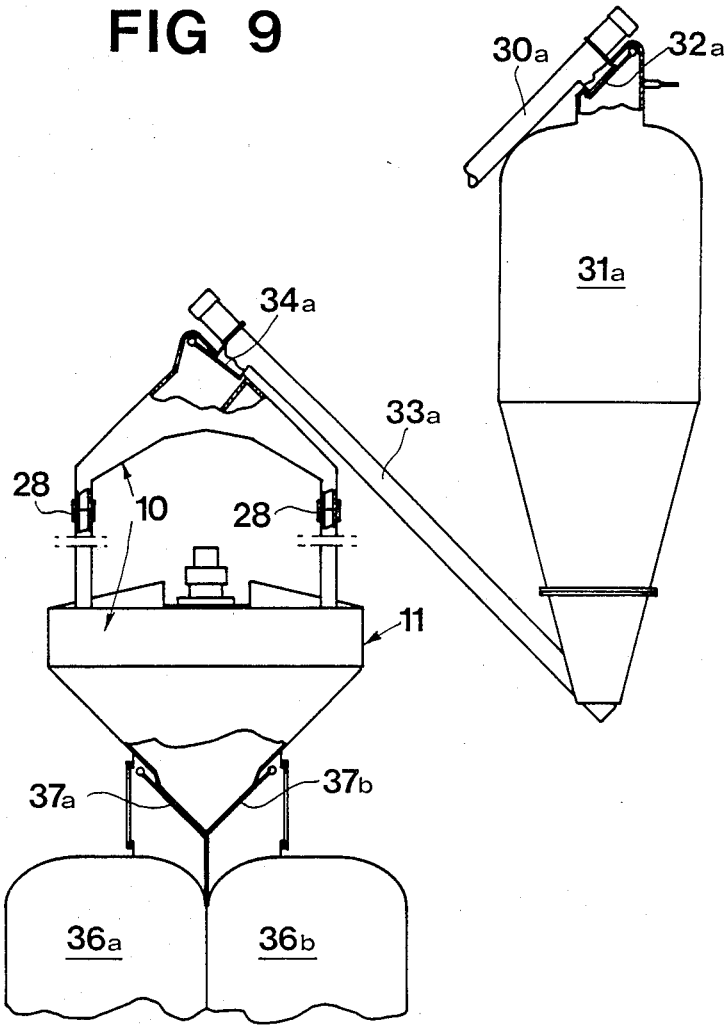
FIG. 9 is a side elevational view with parts broken away to show in cross section parts of the mill plant shown in FIG. 8

In FIG. 8 is shown a flow diagram of a recirculation device for a centrifugal mill according to the invention and having two parallel operation lines for providing a continuous operation of the mill. The raw material is fed to a silo 29, which by two feeding channels 30*a* and *b* with conveying means, e.g. a worm conveyor, is connected to two tanks 31*a* and *b*. In each feeding channel 30*a* and *b* an air lock 32*a* and *b* is arranged. The tanks 31*a* and *b* are by feeding channels 33*a* and *b* with conveying means e.g. a worm conveyor, connected to the crushing unit 10. The worm conveyor provides a dosing of the material to the crushing unit and it may be driven with a variable speed for varying the feed speed of the material. Each feeding channel 33*a* and *b* is provided with an air lock 33*a* and *b*.

The crushing unit 10 is provided with two outlets which by feeding channels 35*a* and *b* are connected to tanks 36*a* and *b* for the crushed material. Air locks 37*a* and *b* are arranged in said feeding channels 35*a* and *b*. Return channels 38*a* and *b* with air locks 39*a* and *b* may be provided between the tanks 36*a* and *b* and the crushing unit 10 for recirculating the material to the crushing unit if a repeated crushing is desired.

The tanks 36*a* and *b* are by feeding channels 40*a* and *b* provided with air locks 41*a* and *b* connected to a separator 42, e.g. a sifting device, provided with an outlet channel 43 for material having a sufficiently small particle size and a return channel 44 for material which is to be recirculated through the crushing unit. Said return channel 44 is connected to the silo 29.

Two vacuum pumps 45*a* and *b* are arranged one of which 45*a* communicates with the tanks 31*a* and *b* and the other of which 45*b* communicates with the crushing unit. Filters 46*a* and *b* are arranged between the pumps and the vacuum tubes. When the tank 31*a* has been filled with raw material from the silo 29 the air locks 32*a* and 41*a* are closed and the air locks 34*a* and 37*a* opened and air is evacuated for providing a practically air-void condition between the tanks 31*a* and 36*b*. The air locks 32*b* and 41*b* are opened and the air locks 34*b*, 37*b* and 39*b* are closed.

Raw material from the tank 31*a* is fed to the crushing unit and after the crushing operation it is fed to the tank 36*a* where it is stored. Meanwhile crushed material from the tank 36*b* is fed to the separator 42 and raw material is fed to the tank 31*b* from the silo 29.

After this cycle is finished (tank 31*a* emptied) air lock 34*a* is closed and if desired the crushed material in the tank 36*a* can be recirculated to the crushing unit 10. When the crushing operation is finished air locks 32*b* and 41*b* are closed, air locks 34*b* and 37*b* opened, air locks 37*a* and 41*a* opened and air locks 37*a* and 39*a* closed, air is evacuated from the tanks 31*b* and 36*b* and the raw material from the tank 31*b* is fed to the crushing unit at the same time as the tank 31*a* is filled with new raw material from the silo 29 and the crushed material from the tank 36*a* is fed to the separator 42. In this way a continuous operation of the mill is provided.

In certain cases e.g. when the raw material is coal, for which drying of the material is required, the tanks 31*a* and *b* arranged before the crushing unit 10 could be provided with heating coils for drying the material before it is supplied to the crushing unit. The number of tanks 31*a* and *b* is then preferably higher than two, e.g. four. If the drying is performed under vacuum the drying temperature and energy consumption can be kept lower. Excess heat from other operations in a plant can be used for this drying operation.

A pre-crushing device could be arranged between the silo 29 an the tanks 31*a* and *b* as well as a separator which separates particles exceeding a certain size and returns them to the pre-crushing device.

After the crushing an inert gas or a gas adapted to provide a desired reaction with or surfacing of the particles may be introduced into the tanks 36*a* and *b*.

The invention is not limited to the embodiments shown and described since several variations are conceiveable within the scope of the claims.

I claim:

1. A method for producing pulverized materials by comminuting particles of the material comprising:

rotating at least one substantially vertical impact surface located at the peripheral end of a rotor in a closed path about an upstanding axis;

repeatedly moving said at least one impact surface through at least one impact position in said path at the peripheral end of said rotor;

feeding the particles of material to be comminuted in an axial direction downwardly with respect to said rotor just opposite the peripheral end thereof to supply said at least one impact position with particles when said at least one vertical impact surface passes through said at least one impact position;

evacuating and maintaining said path and said feeding and impact areas under a substantial vacuum;

accelerating the particles in the vacuum during the feeding step downwardly towards said at least one impact position;

impacting said accelerated particles in said at least one impact position with sufficient energy to crush them and produce fragments;

projecting the fragments by the impact surface against stationary, vertical impact surfaces outside said path to produce further crushing; and leading the comminuted particles downwardly out of said path immediately after said further crushing on said stationary impact surfaces.

2. The method as claimed in claim 1 and further comprising:

simultaneously feeding said particles of material to said rotating impact surface at circumferentially spaced feeding positions with respect to the path of movement of said impact surface.

3. The method as claimed in claim 2 and further comprising:

feeding the particles of material from a silo to a first storage tank and filling said first storage tank to a predetermined level, evacuating said first storage tank and feeding the material to the accelerating step and impacting steps and on to an evacuated second storage tank;

simultaneously therewith feeding particles of material from said silo to a third storage tank arranged in parallel with said first storage tank and filling said third storage tank to a predetermined level;

after feeding the material in said first storage tank through the accelerating and impacting steps and on to said second storage tank discontinuing the vacuum in said first and second storage tanks and evacuating said third storage tank and a fourth storage tank arranged after the impacting step and in parallel with said second storage tank;

feeding the particles of material from said third storage tank to the accelerating and impacting steps and on to said fourth storage tank; and simultaneously therewith filling said first storage tank with particles of material from said silo.

4. The method as claimed in claim 3 and further comprising:

feeding particles of material from one of said second and fourth storage tanks after filling thereof and discontinuing the vacuum therein to a separator;

separating particles of material having a particle size exceeding a certain value in said separator and recirculating them to said silo and feeding the rest of the particles to an outlet channel.

5. The method as claimed in claim 3 and further comprising:

feeding the particles of material from said first and third storage tanks to said accelerating step at a variable speed and thereby measuring the amount of particles during feeding to produce a predetermined sufficient amount of particles fed to the accelerating step.

6. The method as claimed in claim 3 and further comprising:

recirculating in a vacuum at least a portion of the particles in at least one of said second and fourth storage tanks to be re-accelerated in the accelerating step.

7. The method as claimed in claim 3 and further comprising:

drying the particles of material during storing in said second and fourth storage tanks.

8. The method as claimed in claim 3 and further comprising:

introducing into said second and fourth tanks a gas selected from the group of an inert gas and a gas adapted to provide a desired surfacing of the particles of material.

9. The method as claimed in claim 3 and further comprising:

introducing into said second and fourth tanks a gas selected from the group of an inert gas and a gas adapted to provide a desired reaction with the particles of material.

10. An apparatus for producing pulverized materials by comminuting particles of the material in a mill, comprising:

a housing;

a rotor rotatable in said housing about an upstanding axis;

at least one substantially vertical impact surface at the peripheral end of said rotor describing a closed path in said housing of said rotor having at least one impact position;

means for evacuating said path and the feeding and impact areas in said housing and maintaining a substantial vacuum;

means for feeding and accelerating said particles in an axial direction downwardly with respect to said rotor at the peripheral end thereof with a velocity sufficient to keep said at least one impact position supplied with particles when said at least one impact surface passes said at least one position;

means for rotating said rotor with sufficient speed to crush the particles in said at least one impact position by the impact energy of said at least one impact surface, said impact surface projecting the particle fragments therefrom;

vertical stationary impact surfaces in said housing for further crushing the particle fragments projected from said at least one position; said stationary impact surfaces being oriented substantially parallel to said at least one rotor impact surface at said at least one impact position so that the particles projected by said rotor impact surface impact against said stationary impact surfaces substantially perpendicularly; and means for leading the particles downwardly out of said path immediately after said further crushing on said stationary impact surfaces.

11. The apparatus as claimed in claim 10 and further comprising:

a particle accelerator incorporating an upstanding evacuated tube having a length sufficient to produce a free fall velocity implementing the crushing of the particles by said rotor impact surface.

12. The apparatus as claimed in claim 11 wherein said feeding means comprise:

a plurality of said evacuated tubes circumferentially spaced so that the particles therefrom pass through the path of travel of said rotor impact surface.

13. The apparatus as claimed in claim 10 and further comprising:

a particle accelerator incorporating an upstanding evacuated tube;

a centrifuge device operatively connected to said evacuated tube; and means to drive said centrifuge at sufficient speed to project the particles through said tube with a velocity implementing the crushing of the particles at said rotor impact surface.

14. The apparatus as claimed in claim 13 wherein said particle accelerator comprises:

a plurality of said evacuated tubes and centrifuge devices; and outlets for said tubes circumferentially spaced so that the particles therefrom pass through the path of travel of said at least one rotor impact surface.

15. The apparatus as claimed in claim 13 and further comprising:

at least two parallel operation lines each comprising:

a pair of storage tanks the first of which is connected to said particle accelerator through a second feeding channel and the second of which is connected to the outlet of the centrifugal mill through a third feeding channel;

a silo which through a first feeding channel is connected to said first tank;

a separator which through a fourth feeding channel is connected to said second tank;

a return channel connecting the separator and said silo;

said separator further being provided with an outlet channel;

means for generating a vacuum in said first and second tanks in one of said operation lines and causing the particles of material stored in said first tank to pass through the centrifugal mill to said second tank and for simultaneously closing the connection between the centrifugal mill and the first and second tanks in the other operation line and causing filling of the first tank in said other operation line from said silo and emptying of the second tank in said other operation line to said separator and alternating the procedure between the operation lines for providing a continuous operation.

16. The apparatus as claimed in claim 15 and further comprising:

conveying means in the second feeding channel connecting the first tank and the particle accelerator;

and means for varying the speed of said conveying means for measuring the amount of particles fed to the particle accelerator.

17. The apparatus as claimed in claim 15 and further comprising:

heating means in said first tank for drying the particles of material during storing therein.

18. The apparatus as claimed in claim 10 and further comprising:

attachment means for detachably attaching the stationary impact surfaces in said housing, said attachment means comprising plates received in apertures in said housing and detachably fixed thereto and said stationary impact surfaces being fixed to said plates.

* * * * *